United States Patent [19]

Smith

[11] 4,205,717

[45] Jun. 3, 1980

[54] ROTARY POURING SYSTEM

[76] Inventor: Frank B. Smith, Medford, N.J.

[21] Appl. No.: 964,020

[22] Filed: Nov. 27, 1978

Related U.S. Application Data

[63] Continuation-in-part of Ser. No. 862,325, Dec. 20, 1977, Pat. No. 4,168,739.

[51] Int. Cl.[2] ..... B22D 41/04; B22D 41/12

[52] U.S. Cl. ..... 164/154; 164/323; 164/335

[58] Field of Search ..... 164/154, 155, 130, 136, 164/4, 323, 335, 336

[56] References Cited

U.S. PATENT DOCUMENTS

| | | | |
|---|---|---|---|
| 1,354,732 | 10/1920 | Disinger | 164/335 X |
| 2,806,264 | 9/1957 | Keating | 164/336 X |
| 3,095,620 | 7/1963 | Péras | 164/335 X |
| 3,122,800 | 3/1964 | Naffziger | 164/155 |
| 3,398,782 | 8/1968 | Lauterjung | 164/336 |
| 3,470,941 | 10/1969 | Thompson | 164/133 X |
| 3,537,489 | 11/1970 | Hall | 164/155 X |
| 3,923,201 | 12/1975 | Hersh et al. | 164/336 X |
| 3,977,461 | 8/1976 | Pol et al. | 164/155 |
| 4,033,403 | 7/1977 | Seaton et al. | 164/155 |

*Primary Examiner*—Robert D. Baldwin
*Assistant Examiner*—J. Reed Batten, Jr.
*Attorney, Agent, or Firm*—Seidel, Gonda, Goldhammer & Panitch

[57] ABSTRACT

A plurality of carriages, each containing a pouring ladle, are provided for pouring molten metal into moving molds of a conveyor. The carriages are essentially driven from a single motor and move in a closed loop containing a loading zone and a pouring zone. Each carriage contains a clutch pump to control movement along the loop. Rotation of ladles to a pour position is attained by use of a parallelogram linkage on the carriage and remotely located variable pour rate controls. A sensor system including an extension arm is supported by each carriage for sensing the presence of a mold car and for causing the carriage to match the speed of the mold.

10 Claims, 15 Drawing Figures

FIG. 7
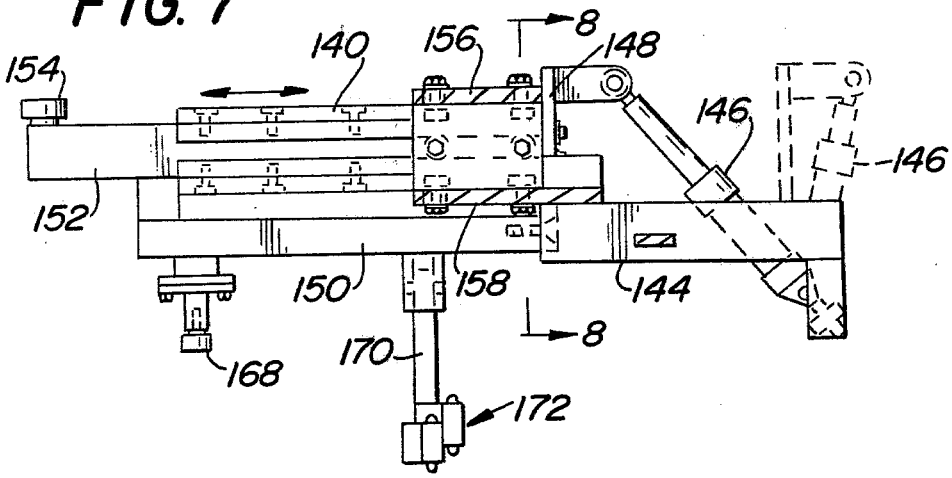
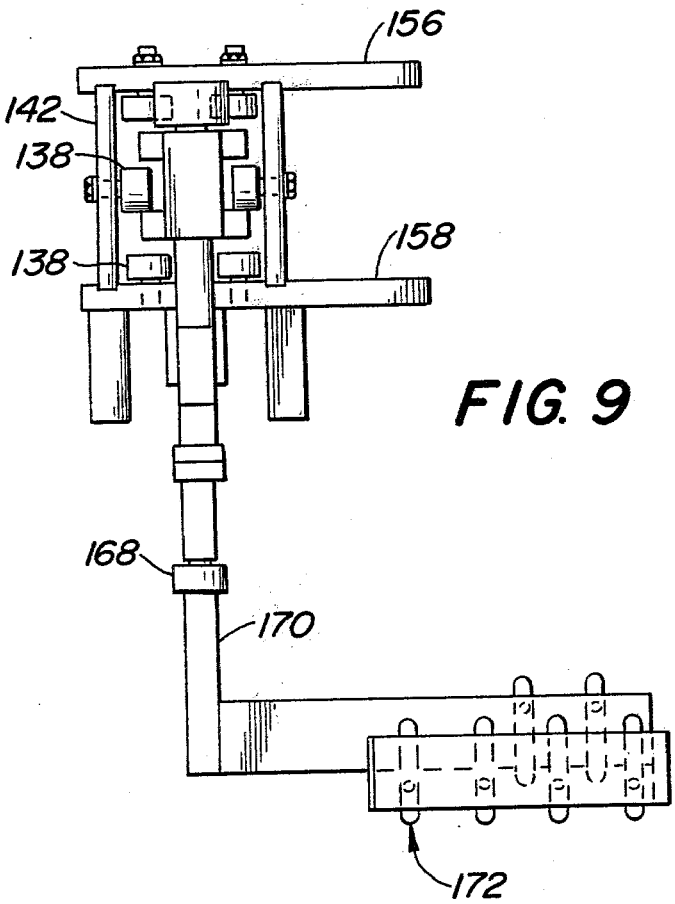
FIG. 9

ROTARY POURING SYSTEM

RELATED APPLICATION

This application is a continuation-in-part of pending application Ser. No. 862,325 filed on Dec. 20, 1977, now U.S. Pat. No. 4,168,739 issued Sept. 25, 1979 and entitled "Rotary Pouring System".

BACKGROUND

When the system disclosed in the above-mentioned patent application was installed for use in connection with a mold conveyor which moved at a slow speed of about 1 inch per second and characterized by a jerky movement of the molds, the sensor means disclosed in said application resulted in erratic action. Thus, a precise alignment between the mold sprue cup and the ladle was not consistently maintained. The present invention is directed to a rotary pour system as disclosed in said application but with a modified sensor means particularly adapted for use with a slow and/or erratically moving mold conveyor.

SUMMARY OF THE INVENTION

The present invention is directed to a rotary pouring system having a plurality of carriages. Each of the carriages supports a ladle rotatable between a fill position and a pour position. The carriages are guided for movement in a closed loop adjacent a loading zone where ladles are filled and a pouring zone where ladles are rotated to their pour position for pouring molten metal into molds.

The rotary pouring system includes a common drive means for driving the carriages. A sensor system including a sensor arm is associated with each carriage for sensing the presence of a mold car and for causing the carriage to attain a mold tracking speed. A device such as a clutch means couples each carriage to the common drive means.

Various advantages of the present invention over the prior art are disclosed in said co-pending application and are incorporated herein by reference. In addition, the present invention includes a sensor system which is comprised of substantially fewer components while being capable of use with slow and/or erratically moving mold conveyors as well as with fast, smooth running conveyors.

Other objects and advantages will appear hereinafter.

For the purpose of illustrating the invention, there is shown in the drawings a form which is presently preferred; it being understood, however, that this invention is not limited to the precise arrangements and instrumentalities shown.

FIG. 7 is a sectional view taken along the line 7—7 in FIG. 6.

FIG. 9 is a elevation view of the apparatus shown in FIG. 7 as seen from the lefthand end thereof.

Figure 1:
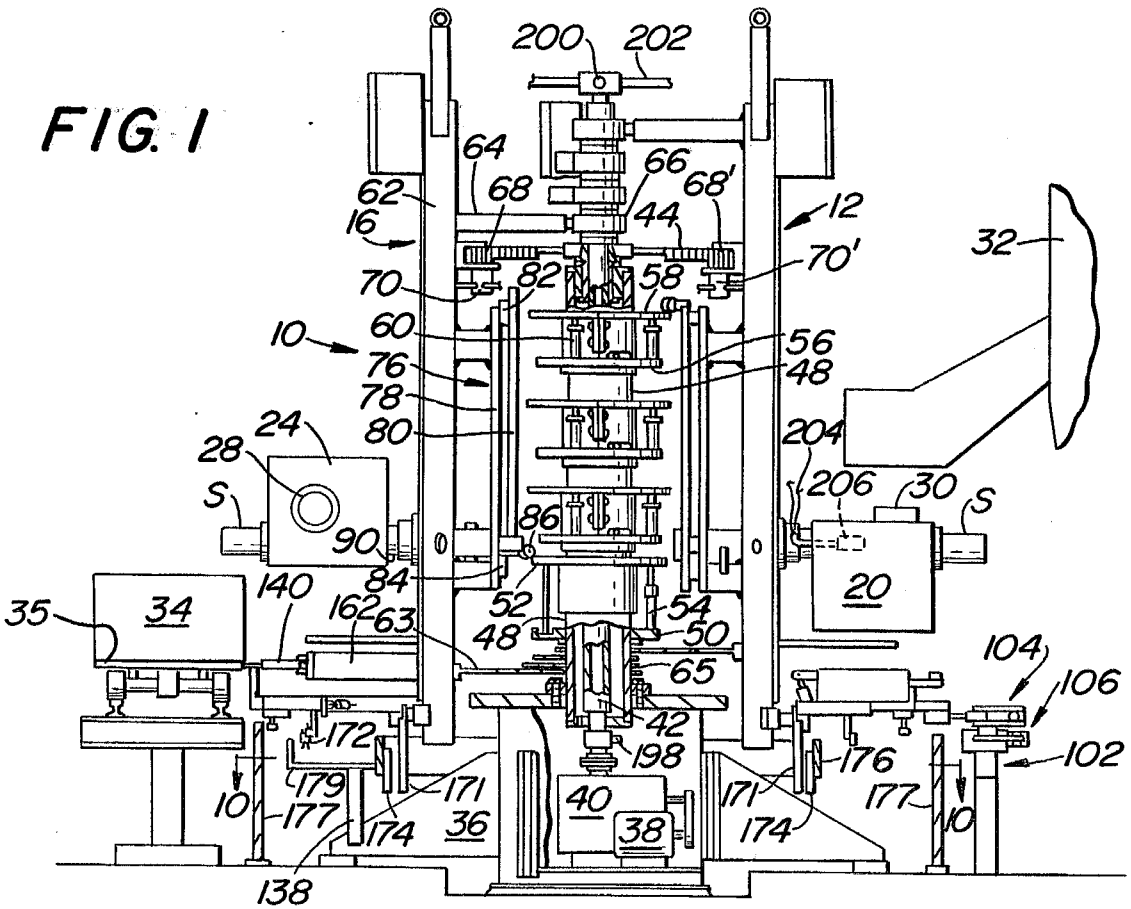
FIG. 1 is a vertical sectional view through the apparatus of the present invention with portions shown in section.

Referring to the drawings in detail, wherein like numerals indicate like elements, there is shown a rotary pouring system in accordance with the present invention designated generally as 10. The system 10 includes for purposes of illustration four carriages designated 12, 14, 16 and 18. A greater or lesser number of carriages may be provided as desired.

The carriages 12, 14, 16 and 18 are respectively provided with ladles 20, 22, 24 and 26. Each ladle has a fill port and a spout designated S for discharge of molten metal from the ladles. Referring to FIG. 1, the fill port on ladle 24 is designated 28 and the fill port on ladle 20 is designated 30.

Figure 2:
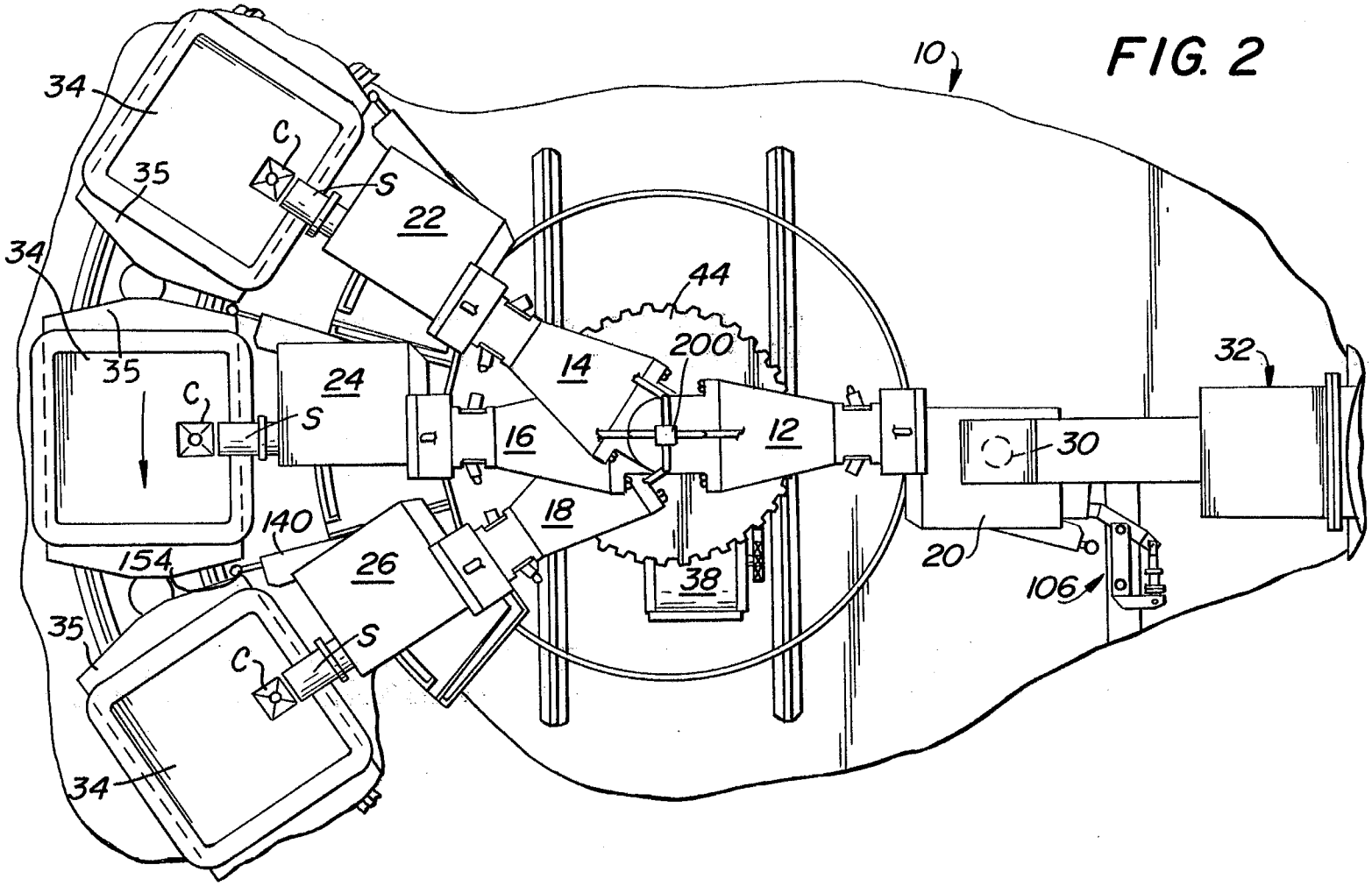
FIG. 2 is a top plan view of the apparatus shown in FIG. 1.

The carriages are supported and driven for rotation through a closed loop. Adjacent the closed loop, there is provided a holding vessel 32 having a large supply of molten metal which is selectively discharged through the fill port on the ladles when they are in a fill position. In FIGS. 1 and 2, ladle 20 on carriage 12 is in a fill position while the remaining carriages are in a pour position. In the pour position, the ladles are adapted to pour molten metal into molds 34 made of sand or the like and part of a conveyor which includes interconnected mold cars 35 for supporting the molds. The manner in which the molds 34 are conveyed past the closed loop is conventional and forms no part of the present invention.

The apparatus 10 includes a base 36 on which is supported a motor 38. Motor 38 is connected by way of a gear reducer 40 to a vertically disposed drive shaft 42. The upper end of the drive shaft 42 is connected to and drives a large diameter ring gear 44. A center column 48 is supported by the stationary base 36 and surrounds the drive shaft 42. Gear 44, shaft 42, and center column 48 are coaxial. Column 48 is provided with sets of pour actuators corresponding in number to the number of carriages. Each pour actuator is comprised of a plate fixed to the center column and a movable cam plate. Each cam plate surrounds the center column 48 and is connected to its associated fixed plate by cylinders which are selectively actuated from a remote location.

Figure 11:
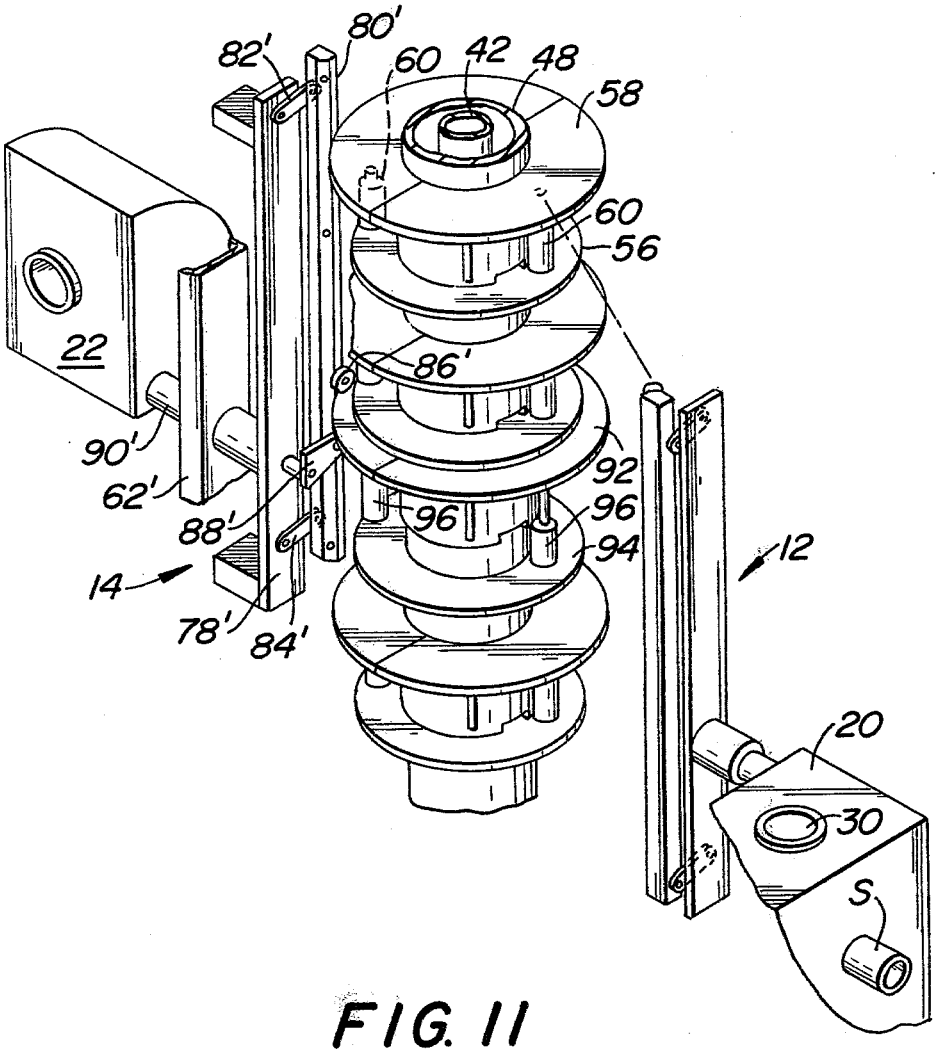
FIG. 11 is a partial perspective exploded view showing two carriages in part and a central column in part.

Referring to FIG. 1, plate 50 is fixed to center column 48 and a cam plate 52 is slideably guided by the center column 48. Cylinders 54 are secured to the fixed plate 50. Piston rods extending from the cylinders push up on the lower surface of the cam plate 52. Elements 50, 52 and 54 constitute the pour actuator for ladle 24 on carriage 16. The pour actuator for ladle 20 on carriage 12 includes a plate 56 fixed to the center column 48 and cam plate 58 slideably guided by center column 48. See FIGS. 1 and 11. Cylinders 60 are connected to the fixed plate 56. Piston rods extending from the cylinders 60 push up on the lower surface of the cam plate 58.

The carriage 16 includes a vertically disposed post 62 having an arm 64 adjacent its upper end. Arm 64 is connected to a bearing 66 which surrounds the drive shaft 42. Post 62 has an arm 63 adjacent its lower end which is connected to a bearing 65 which surrounds the column 48. Post 62 rotatably supports a pinion 68 meshed with the periphery of gear 44. A clutch pump 70 is driven by pinion 68. The pour actuator associated with carriage 16 is coupled to the ladle 24 by way of a parallelogram linkage 76. The linkage 76 includes elongated vertically disposed links 78 and 80. Link 78 is stationary and supported by the post 62. Movable link 80 is pivotably connected to link 78 by short links 82 and 84.

Figure 12:
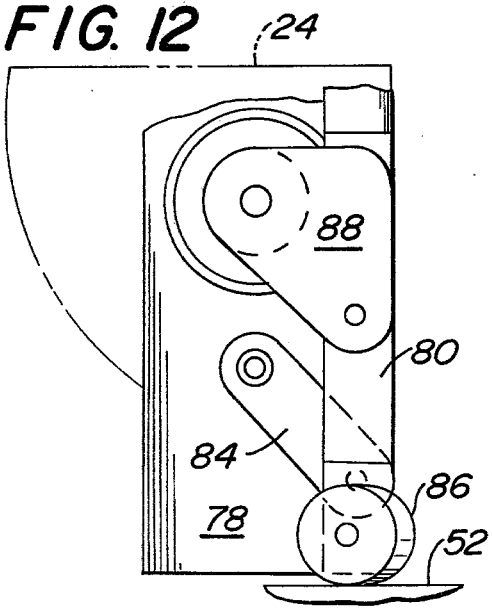
FIG. 12 is an enlarged detail view of a part of the parallelogram linkage shown in the fill position of a ladle.
Figure 13:
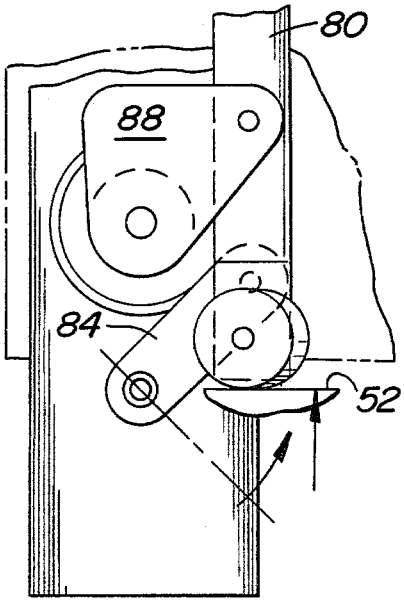
FIG. 13 is a view similar to FIG. 12 but showing the linkage in the pour position of the ladle.

Referring to FIGS. 1, 12 and 13, it will be noted that the link 80 rotatably supports a cam follower 86 which rides on the cam plate 52. As cam plate 52 is elevated by the cylinders 54, as shown by a comparison of FIGS. 12 and 13, link 80 is elevated. A link 88 is pivotably connected to link 80 intermediate its ends and is also fixedly connected to the support shaft 90 for ladle 24. Hence, when link 80 is raised from the position shown in FIG. 12 to the position shown in FIG. 13, the ladle 24 is rotated from its fill position to its pour position.

The other carriages are similarly interrelated with a pour actuator on the center column 48. For example, see FIG. 11 wherein corresponding elements are provided with corresponding primed numerals. The support shaft 90' for the ladle 22 is at the same elevation as that of shaft 90. The cam follower 86' is at an elevation so that it may be actuated by the cam plate 92 associated with fixed plate 94 on the center column 48. The cylinders 96 are shown in activated position in FIG. 11. The links 80, 80' are identical and may be used interchangeably although certain holes in the links will not be used depending upon the particular carriage involved.

Figure 3:
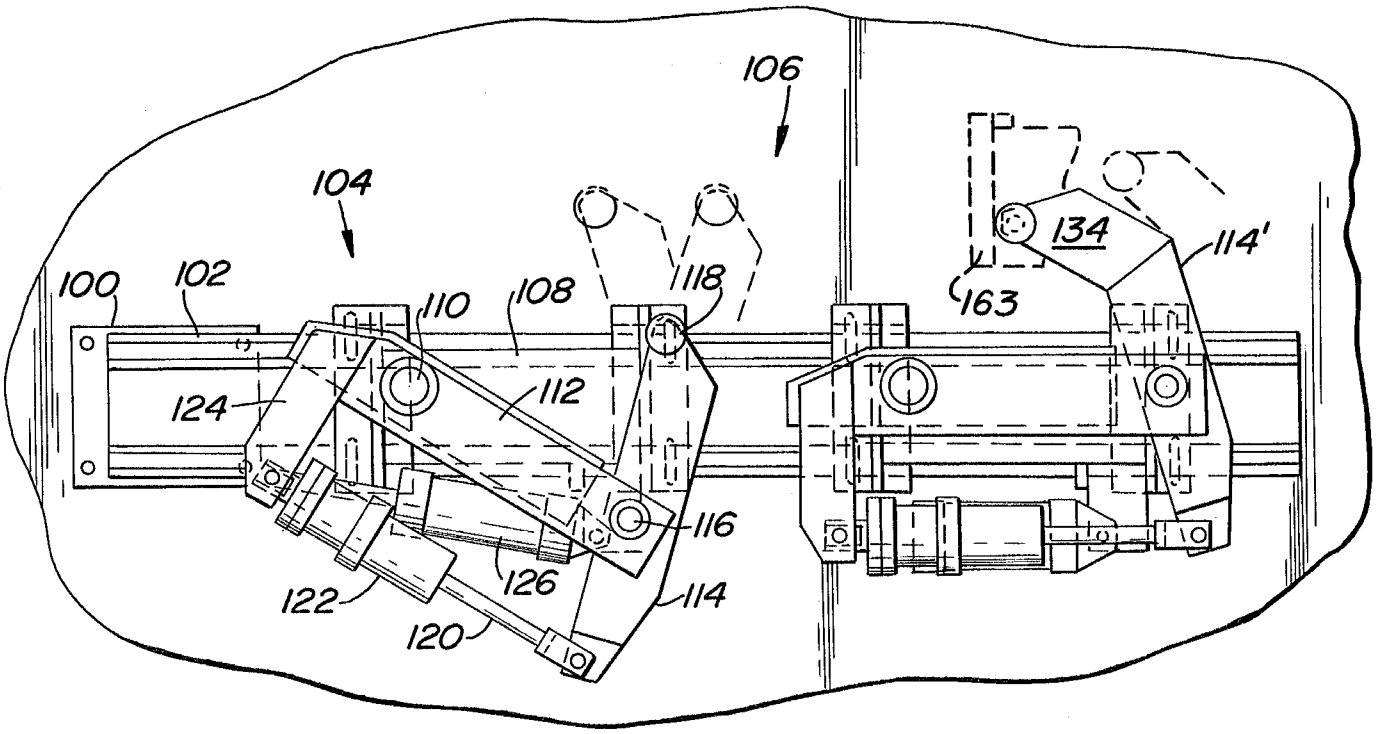
FIG. 3 is a top plan view of the braking apparatus at the prefill and fill stations.
Figure 4:
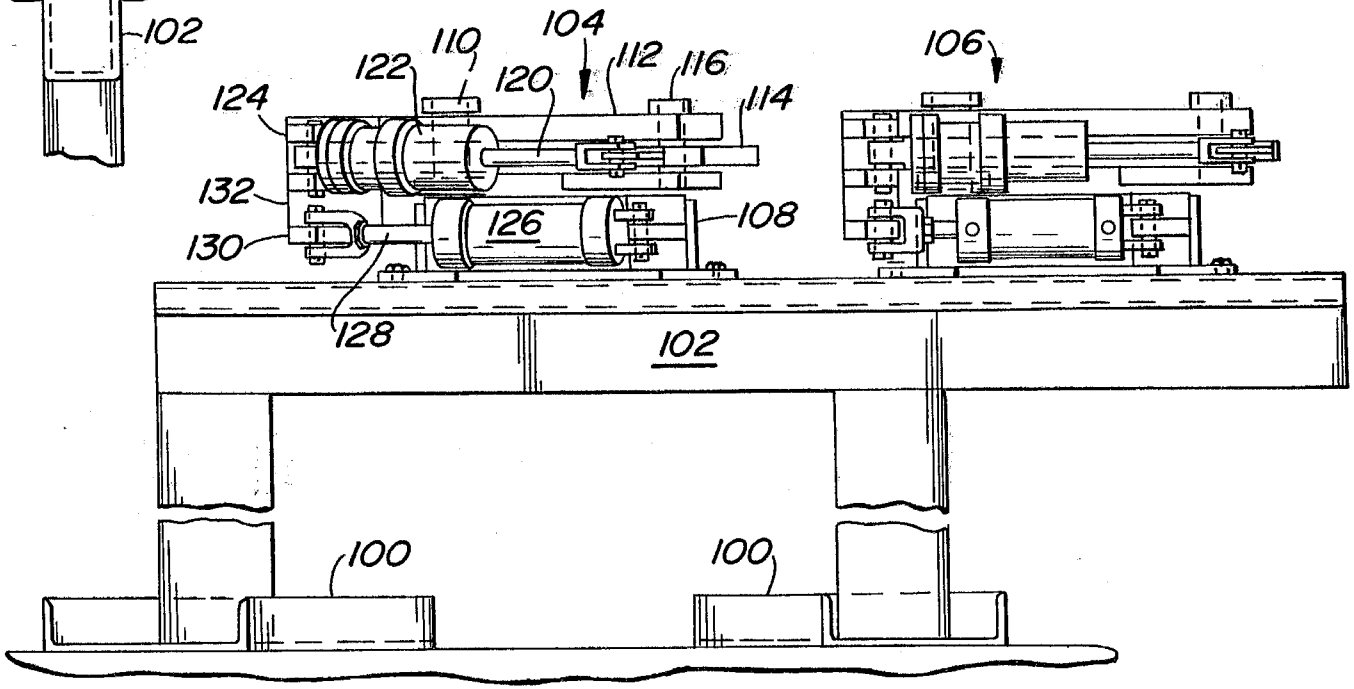
FIG. 4 is an elevation view of the apparatus shown in FIG. 3.
Figure 5:
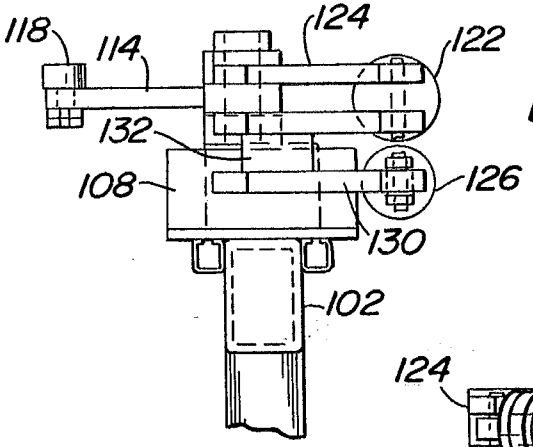
FIG. 5 is an end view of the apparatus shown in FIG. 4 when viewed from the lefthand side of FIG. 4.
Figure 8:
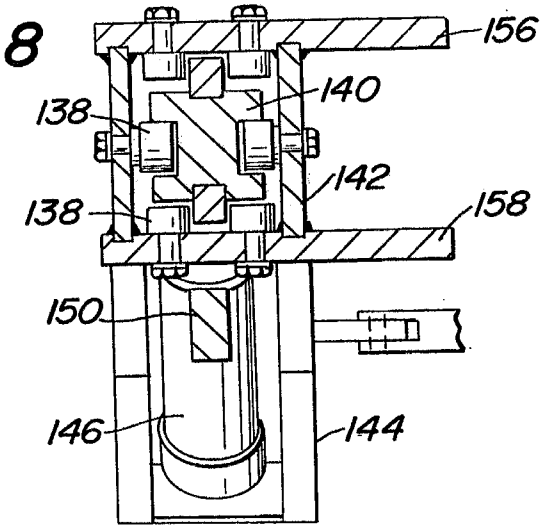
FIG. 8 is a sectional view taken along the line 8—8 in FIG. 7.
Figure 6:
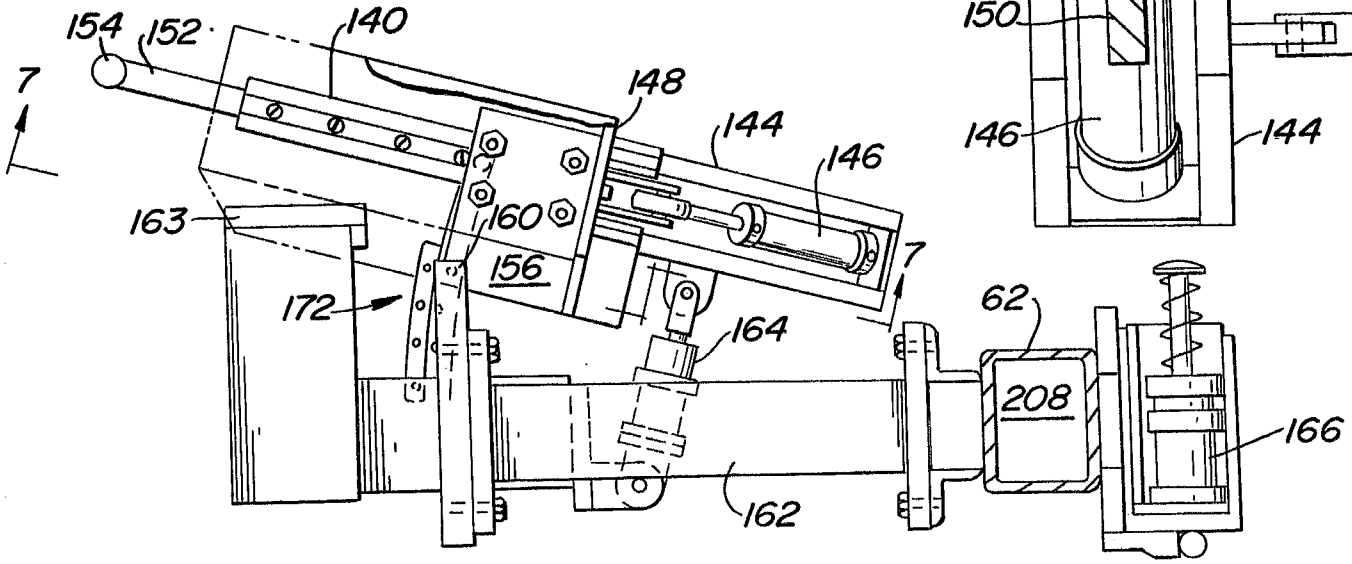
FIG. 6 is a top plan view of the sensor arm and its support.

Referring to FIGS. 3–5 inclusive, there is shown a prefill stop mechanism 104 at a prefill station and a fill stop mechanism 106 at the fill station. The mechanisms 104 and 106 are mounted on a common support stand 102 having floor engaging channels 100 at its lower end. The mechanisms 104 and 106 are identical (except as set forth hereinafter) and therefore only mechanism 104 will be described in detail. Mechanisms 104, 106 are alternatively operative.

The mechanism 104 includes a base 108 which is adjustably positionable at different locations along the top of the support stand 102 and is removably bolted thereto. The base 108 includes a vertically disposed pivot pin 110.

As shown more clearly in FIGS. 3 and 4, an operating arm 112 is mounted for pivotable movement about the axis of pin 110. A control arm 114 is pivotably connected to the arm 112 by pivot pin 116 at a location between the ends of arm 114. One end of the arm 114 has a roller 118 mounted in a bearing. The other end of arm 114 is pivotably connected to one end of a rod 120 forming part of the shock absorber 122. The other end of shock absorber 122 is pivotably connected to one end of a bifurcated extension 124. Extension 124 is integral with arm 112. In view of its extension 124, the arm 112 in plan view may be considered with a L-shaped arm.

As shown more clearly in FIG. 4, a cylinder 126 has one end thereof pivotably connected to a portion of the stationary base 108. Cylinder 126 is at an elevation below the elevation of the shock absorber 122. A piston rod 128 extending from the cylinder 126 is provided at its free end with a clevis pivotably connected to a plate 130. Plate 130 is integrally connected by way of block 132 to the extension 124. Hence, the cylinder 126 causes the arm 112 to pivot about the axis of pin 110 to thereby move the control arm 114 between an extended and retracted position. The mechanism 106 is the same as the mechanism 104 except for the projection 134 on the control arm 114'. Mechanism 104 stops a carriage in the prefill position and mechanism 106 stops the carriage at the fill station when the carriage is moving from left to right in FIG. 3.

A sensor means is associated with each carriage for sensing the presence of a mold and for causing the carriage to attain a mold tracking speed. Referring to FIGS. 6–9 inclusive, there is shown such sensing means associated with the carriage 16. A sensing arm 140 is horizontally disposed and extends generally outwardly with respect to column 48. Arm 140 extends through a frame guide 142 supporting a plurality of guide rollers 138 which cooperate with a juxtaposed surface on the arm 140. See FIG. 8. The frame guide 142 is mounted on a frame 144. A cylinder 146 has one end pivotably connected to the frame 144 and its piston rod pivotably connected to a clevis on end plate 148. End plate 148 is connected to one end of the arm 140. See FIGS. 6 and 7. Cylinder 146 is an over the center device whereby it biases arm 140 radially inwardly or outwardly depending on the position of arm 140.

A mounting member 150 is disposed below the elevation of the arm 140. One end of member 150 is connected to the plate 148. The other end of the member 150 is connected to the arm 140 at an extension 152 thereof. Extension 152 terminates in a roller 154.

The frame guide 142 includes horizontally disposed projection plates 156 and 158 disposed one above the other. See FIGS. 8 and 9. Plates 156 and 158 are pivotably connected by way of pin 160 to a bracket arm 162. See FIG. 6. Bracket arm 162 is a cantilever fixedly secured at one end to post 62 and is supported by the post 62. A contact plate 163 depends from arm 162 and is adapted to be contacted by roller 118 of mechanisms 104, 106. A shock absorber 164 has one end pivotably connected to the bracket arm 162 and its other end pivotably connected to the frame 144. A cam follower 168 is supported in depending relation from member 150. See FIG. 7. A bracket 170 supports a magnet assembly 172. Bracket 170 is also supported by member 150. See FIGS. 7 and 9. As shown more clearly in FIG. 7, the magnet assembly 172 is disposed radially inwardly from the position of the cam follower 168.

Figure 10:
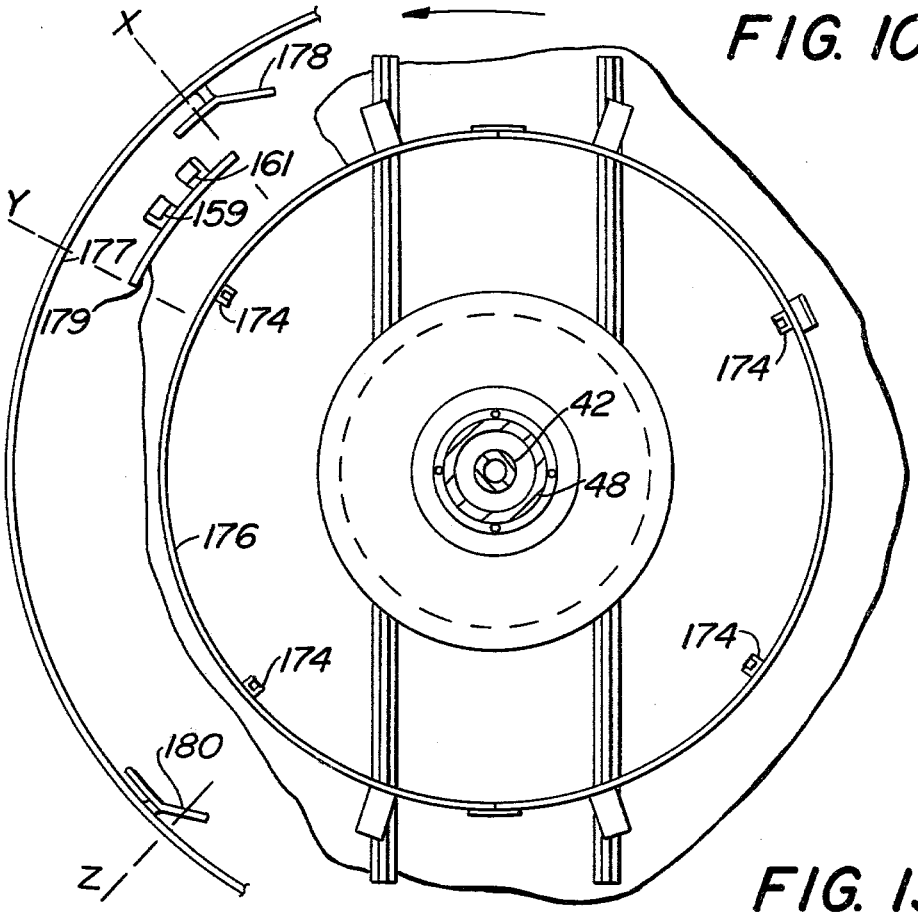
FIG. 10 is a sectional view as seen along the line 10—10 in FIG. 1.

As shown more clearly in FIGS. 1 and 10, four housings 174 containing a plurality of magnetically actuable switches are supported by annular plate 176 adjacent the lower edge thereof and radially inwardly of plate 176. The housings 174 are in a location so as to cooperate with the magnet assembly 171 on each of the carriages. Assembly 171 includes a plurality of magnets each adapted to actuate one of the switches in the housings 174 as the assembly 171 passes the housings 174. The magnets in the various assemblies are positioned differently so that the switches in housings 174 can generate a signal which identifies the specific carriage.

Within the annular heat shield 177, there is provided a fixed stationary activating cam 178 and a fixed stationary deactivating cam 180. See FIG. 10. The cams 178 and 180 are positioned for cooperation with the cam follower 168. Contact between cam follower 168 and cam 178 causes the arm 140 to move radially outwardly. Contact between cam follower 168 and cam 180 causes the arm 140 to move radially inwardly. Magnetically actuable switches 159 and 161 are supported by a bracket 179 attached to base 36 via member 138. Movement of the arm 140 into the space between adjacent molds on the conveyor cars and the subsequent rotation of arm 140 causes the magnets of assembly 172 to close contacts of switches 159 and/or 161 to initiate pouring of the ladle.

Referring to FIG. 1, a gas supply conduit 198 is connected to the interior of the hollow drive shaft 42. At the upper end of the drive shaft 42, there is provided a distributor 200 supported by way of a pipe swivel on the upper end of the drive shaft 42. From the distributor 200, a plurality of flexible conduits 202 extend radially outwardly so that each extends to the vertical post of one of the carriages. Each conduit 202 extends downwardly along the post of its carriage to conduit 204 supported by the ladle. The ladle is preferably provided internally with a refractory lining and a burner nozzle 206. Thus, combustible gas may be supplied to each of the ladles on each of the carriages to maintain the temperature of the ladle refractory at the desired elevation. If the mold line stops due to a malfunction, the ladle refractory is maintained at the proper temperature by the heat from the burner nozzle 206 until the malfunction is corrected.

Figure 15:
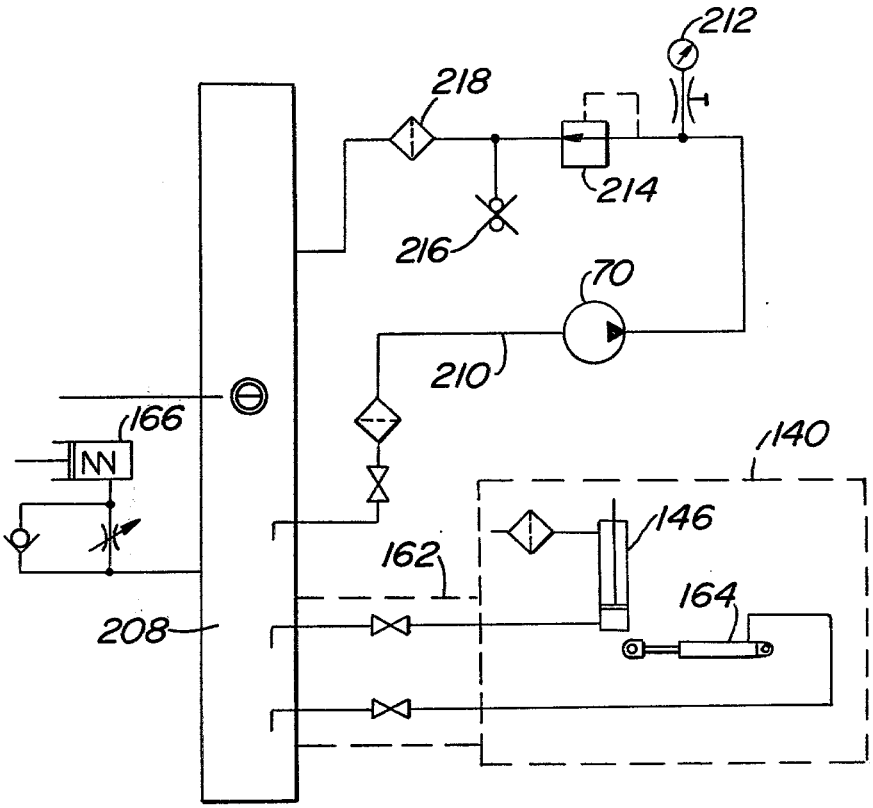
FIG. 15 is a simplified hydraulic schematic diagram.

Referring to FIG. 15, the vertical post on each carriage is hollow and forms therein a hydraulic tank 208. Each of the ends of a conduit 210 communicate with the tank 208. The conduit 210 couples the inlet and outlet of the clutch pump 70 to the tank 208. On the inlet side of clutch pump 70, the conduit 210 includes a filter. On the outlet side of the clutch pump 70, the conduit 210 includes a pressure gauge 212, a back pressure regulator valve 214, an oil fill connection 216, and a filter 218. The cylinder 146 and the shock absorber 164 associated with the arm 140 are likewise coupled to the tank 208. Also, shock absorber 166 is connected to the tank 208. The oil in tank 208 is under pressure by way of an air cushion at about 75 psi.

Figure 14:
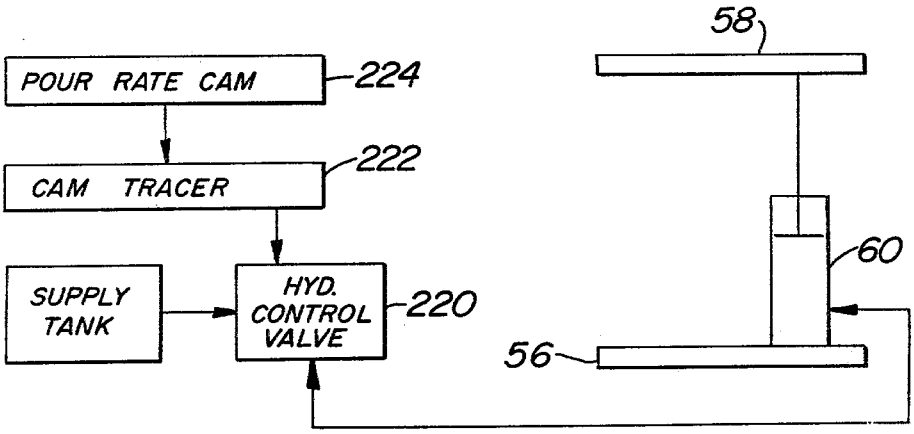
FIG. 14 is a simplified schematic diagram illustrating the relationship of components for controlling the pouring rate of a ladle.

Referring to FIG. 14, the rate at which hydraulic fluid is transmitted to a cylinder for effecting a pouring of molten metal in a mold 34 is controlled by a hydraulic control valve 220. Control valve 220 is responsive to a tracer 222 which follows the curve of a pouring rate cam 224 and supplies oil to cylinders 60 at a flow rate proportional to the signal from cam tracer 222. The cylinders 60 control the position of cam plate 58 which in turn is a direct function of the rotative position of the ladle such as ladle 20. Cam 224, tracer 222, and hydraulic control valve 220 are located in any convenient location at a console remote from the environment of the apparatus 10. The function of cam 224 and the tracer 222 may be accomplished electronically in a manner known to those skilled in the art.

In view of the above description, the drawings attached hereto, the above-identified co-pending application, and the state of the art, the following brief description of operation is deemed adequate.

When a mold car 35 enters the pouring zone at location X in FIG. 10, it must be "qualified" for pour. That is:

(a) It must be far enough into the pouring zone for pouring to be completed should the mold line unexpectedly stop;
(b) The mold car must be carrying a mold 34;
(c) The mold 34 cannot have been previously designated a "bad mold" by a molding machine operator who enters this information into a shift register.

If the new mold car meets all of the above qualifications, the vessel 32 automatically dispenses a predetermined quantity of molten metal into a waiting ladle at the fill station. Post-inoculant material may be metered into the ladle with the metal stream at this point or may be dispensed directly into the unfilled ladle at the prefill station adjacent to the fill station. When the ladle is filled, the ladle is released by the control arm 114 moving to the inoperative position.

After the carriage is released by mechanism 106, it is driven at a speed well in excess of the speed of the mold conveyor to the pouring zone XZ by motor 38, gear 44 and pinion 68. Zone XY is the mold engagement zone. At location X, the cam follower 168 contacts cam 178 to thereby move the arm 140 radially outwardly into the space behind a mold car 35. In the event that a mold car is directly in front of the arm 140, roller 154 contacts the side of that mold car and cylinder 146, driven by oil pressure from hydraulic tank 208, maintains a bias pressure so that the arm 140 will immediately enter the space in front of that mold car as the carriage continues to rotate and contact a rear surface of the next adjacent mold car. After initial contact, arm 140 pivots about pin 160 and shock absorber 164 cushions the speed transition change of arm 140. When the arm 140 is in a position behind and in contact with a mold car, the carriage tracks the speed of the mold 34 on that car so that the spout S is aligned with the sprue cup C of mold 34. A magnet in assembly 171 trips a switch 174 at the 2 o'clock position in FIG. 10 to identify the carriage to the console and thereafter another magnet of assembly 172 trips switch 159 and/or 161 to initiate a pour signal.

Prior to engagement with a mold car in zone XY, arm 140 moves faster than the mold car 35 and therefore upon engagement will try to push the mold car. The force of the mold car on the arm 140, and vice versa, is directly related to the pressure in conduit 210 between clutch pump 70 and back pressure regulator valve 214. As that force increases, the fluid pressure downstream from pump 70 increases. As described above, gear 44 drives the carriage by way of pinion 68 which drives clutch pump 70. Arm 140 moves with its support bracket 162 which is fixed to its carriage.

When the force on arm 140 causes the pressure in conduit 210 downstream from pump 70 to equal the spring adjusted pressure setting in back pressure regulator valve 214, oil will flow through valve 214 back to tank 208 thereby permitting the shaft of pump 70 to rotate. Clutch pump 70 then acts as a partially engaged clutch and permits the carriage to slow down until the force on arm 140 is limited so as to be equivalent to the hydraulic pressure setting on regulator valve 124.

When the carriage identity signal and pour signal are received at the console, hydraulic control valve 220 directs hydraulic fluid to the appropriate pour actuator in direct proportion to the pour rate curve selected. A cam plate such as cam plate 58 is elevated to cause shaft 90 to rotate and pour the molten metal into the mold. The pouring rate is independent of the speed or the position of the carriage so long as the carriage is in the pouring zone designated XZ in FIG. 10.

When the carriage reaches the end of the pouring zone designated by Z, the arm 140 is cammed radially inwardly to its inoperative position by contact between cam follower 168 and cam 180. Thereafter, the carriage can move at a high speed to the prefill or fill stations where it is stopped by the mechanisms 104 or 106, respectively. At the end of the pouring zone, one or more magnets of assembly 171 will trip switch 174 at seven o'clock of FIG. 10 to identify the carriage to the console so that the control valve 220 will permit fluid to bleed out of its associated pour actuator whereby the ladle will by gravity rotate back to its fill position.

The present invention may be embodied in other specific forms without departing from the spirit or essential attributes thereof and, accordingly, reference should be made to the appended claims, rather than to the foregoing specification, as indicating the scope of the invention.

I claim:

1. A rotary pouring system comprising a plurality of carriages each supporting a ladle rotation from a fill position to a pour position, means for guiding said carriages in a closed loop having a loading zone where ladles are filled and a pouring zone where ladles are rotated to a pour position, a common drive means for said carriages, a sensor means supported by each carriage for sensing the presence of a mold and for causing its associated carriage to attain a mold tracking speed, each sensor means including an arm movable generally radially outwardly on each carriage from a retracted position to a mold engaging position, and a discrete device on each carriage selectively coupling its associated carriage to said common drive means and being responsive to said sensor arm.

2. A system in accordance with claim 1 wherein each arm is supported by its associated carriage for pivotable movement about a vertical axis, and a discrete shock absorber for cushioning pivotable movement of each arm.

3. A system in accordance with claim 1 including a cam follower supported in depending relation from each arm and movable therewith.

4. A system in accordance with claim 3 including stationary cams for extending and retracting each arm.

5. A system in accordance with claim 1 including a magnet assembly supported by each arm in depending relation therefrom and movable therewith.

6. A system in accordance with claim 1 including means for biasing each arm to its retracted position and means for biasing each arm to an extended engaging position.

7. A system in accordance with claim 1 wherein each mold sensor means includes a hydraulic circuit having a back pressure regulator valve downstream from a clutch pump forming part of said discrete device so that a restraining force on said arm is directly related to the hydraulic pressure between said clutch pump and said regulator valve.

8. A rotary pouring system comprising a plurality of carriages each supporting a ladle rotatable from a fill position to a pour position, means for guiding said carriages in a closed loop having a loading zone where ladles are filled and a pouring zone where ladles are rotated to a pour position, a common drive means for said carriages, a sensor means supported by each carriage for sensing the presence of a mold and for causing its associated carriage to attain a mold tracking speed, each sensor means including an arm movable generally radially outwardly on each carriage from a retracted position to a mold engaging position, a cam follower supported from each arm and movable therewith, and stationary cams at the pouring zone for moving said arm to its engaging and retracted position by contact with the cam follower.

9. A system in accordance with claim 8 wherein each arm is supported by its associated carriage for pivotable movement about a vertical axis, and a discrete shock absorber for cushioning pivotable movement of each arm.

10. A system in accordance with claim 8 wherein each carriage sensor means includes a hydraulic circuit having a back pressure regulator valve downstream from a clutch pump so that a restraining force on said arm is directly related to the hydraulic pressure between said clutch pump and said regulator valve.

* * * * *

UNITED STATES PATENT OFFICE

CERTIFICATE OF CORRECTION

Patent No. 4,205,717 Dated June 3, 1980

Inventor(s) FRANK B. SMITH

It is certified that error appears in the above-identified patent and that said Letters Patent are hereby corrected as shown below:

Column 7, line 22, change "rotation" to --rotatable--.

Signed and Sealed this

*Thirtieth* Day of *September 1980*

[SEAL]

*Attest:*

SIDNEY A. DIAMOND

*Attesting Officer*

*Commissioner of Patents and Trademarks*